US006680562B1

(12) United States Patent
McGinn et al.

(10) Patent No.: US 6,680,562 B1
(45) Date of Patent: Jan. 20, 2004

(54) SCHOTTKY EMITTER HAVING EXTENDED LIFE

(75) Inventors: James B. McGinn, Portland, OR (US); Sander G. den Hartog, Eindhoven (NL); David S. Jun, Portland, OR (US); Gerald G. Magera, Portland, OR (US); Gregory A. Schwind, Portland, OR (US)

(73) Assignee: FEI Company, Hillsboro, OR (US)

( * ) Notice: Subject to any disclaimer, the term of this patent is extended or adjusted under 35 U.S.C. 154(b) by 494 days.

(21) Appl. No.: 09/639,451

(22) Filed: Aug. 15, 2000

Related U.S. Application Data

(60) Provisional application No. 60/150,047, filed on Aug. 20, 1999.

(51) Int. Cl.[7] ..... H01J 1/16

(52) U.S. Cl. ..... 313/326; 313/336

(58) Field of Search ..... 313/326, 336, 313/346 R, 318, 362.1, 633, 309, 351, 311, 310

(56) References Cited

U.S. PATENT DOCUMENTS 3,814,975 A 6/1974 Wolfe et al. ..... 313/336
4,631,448 A * 12/1986 Tamura et al. ..... 313/362.1
5,449,968 A 9/1995 Terui et al. ..... 313/362.1
5,616,926 A 4/1997 Shinada et al. ..... 250/423
5,763,880 A 6/1998 Nisiyama et al. ..... 250/310
5,838,096 A 11/1998 Shinada et al. ..... 313/336

* cited by examiner

*Primary Examiner*—Nimeshkumar D. Patel
*Assistant Examiner*—Ken A Berck
(74) *Attorney, Agent, or Firm*—Michael O. Scheinberg

(57) ABSTRACT

A electron emission cathode includes an emitter having an apex from which electrons are emitted. The emitter is attached to a heating filament at a junction and extends from the junction both forward toward the apex and rearward. A reservoir of material that lowers the work function of the emitter is positioned on the rearward extending portion of the emitter. By positioning the reservoir on the rearward extending portion, the reservoir can be positioned sufficiently far from the junction to reduce its temperature and thereby greatly increase the useful life, of the emitter without adversely affected the emission characteristics of the source.

31 Claims, 8 Drawing Sheets

SCHOTTKY EMITTER HAVING EXTENDED LIFE

This application claims priority from U.S. Provisional Patent Application No. 60/150,047, which was filed on Aug. 20, 1999 and is hereby incorporated by reference.

TECHNICAL FIELD OF THE INVENTION

The present invention relates to the field of electron sources for use in electron beam applications, and in particular to Schottky emitters.

BACKGROUND OF THE INVENTION

Electron emission cathodes, typically referred to as electron sources, are used in devices such as scanning electron microscopes, transmission electron microscopes, semiconductor inspection systems, and electron beam lithography systems. In such devices, an electron source provides electrons, which are then guided into an intense, finely focused beam of electrons having energies within a narrow range. To facilitate formation of such a beam, the electron source should emit a large number of electrons within a narrow energy band. The electrons should be emitted from a small surface area on the source into a narrow cone of emission. Electron sources can be characterized by a brightness, which is defined as the electron current divided by the real or virtual product oft he emission area and the solid angle through which the electrons are emitted. A practical source should be bright and should operate for an extended period of time with little or no maintenance and minimal noise, that is, variations in the amount and energy of the emitted electrons.

Electrons are normally prevented from leaving the atoms at the surface of an object by an energy barrier. The amount of energy required to overcome the energy barrier is known as the "work function" of the surface. One type of electron source, a thermionic emission source, replies primarily on heat to provide the energy to overcome the energy barrier and emit electrons. Thermionic emission sources are not sufficiently bright for use in many applications.

Another type of electron source, a cold field emission source, operates at room temperature and relies on a strong electric field to facilitate the emission of electrons by tunneling through the energy barrier. A field electron source typically includes a narrow tip at which electrons leave the surface and are ejected into the surrounding vacuum. While cold field emission sources are much smaller and brighter than thermionic emission sources, cold field emission sources exhibit instabilities that cause problems in many applications.

Yet another type of electron source is referred to as a Schottky emission cathode or Schottky emitter. Although the term "Schottky emission" refers to a specific operating mode of an emitter, the term "Schottky emitter" is used more broadly to describe a type of electron emitter that may be capable of operating in a variety of modes, including Schottky emission mode. Schottky emitters use a coating on a heated emitter tip to reduce its work function. The coating typically comprises a very thin layer, such as a fraction of a monolayer, of an active metal. In Schottky emission mode, a Schottky emitter uses a combination of heat and electric field to emit electrons, which appear to radiate from a virtual point source within the tip. With changes to the emitter temperature and electric field, the Schottky emitter will emit in other emission modes or combinations of emission mode, including extended Schottky emission mode and thermal field mode. Schottky emitters are very bright and are more stable and easier to handle than cold field emitters. Because of their performance and reliability benefits, Schottky emitters have become a common electron source for modem focused electron beam systems.

FIG. 1 shows part of a typical prior art Schottky emitter 12, such as the one described in U.S. Pat. No. 3,814,975 to Wolfe et al. for "Electron Emission System." Schottky emitter 12 includes a filament 14 that supports and heats an emitter 16 having an apex 22 from which the electrons are emitted. Applicants herein use the term "emitter" alone to refer to that portion of the electron source from which electrons are emitted (e.g., emitter 16 of FIG. 1) and the term "Schottky emitter" refers to the entire electron source assembly (e.g., Schottky emitter 12), often including a suppressor cap described below. Heating current is supplied to filament 14 through electrodes 24 that penetrate a base 26. Schottky emitter 12 typically operates with apex 22 at a temperature of approximately 1,800 K. Emitter 16 is typically made from a single crystal of tungsten oriented in the <100>, <110>, <111>, or <310> direction. Emitter 16 could also be made of other materials, such as molybdenum, iridium, or rhenium. Emitter 16 is coated with a coating material to lower its work function. Such coating materials could include, for example, compounds, such as oxide, nitrides and carbon compounds, of zirconium, titanium, hafnium, yttrium, niobium, vanadium, thorium, scandium, beryllium or lanthanum. For example, coating a (100) surface of tungsten with zirconium and oxygen lowers the work function of the surface from 4.5 eV to 2.8 eV. By reducing the energy required to emit electrons, the coating on the emitter makes it a brighter electron source.

At the high temperatures at which Schottky emitter 12 operates, the coating material tends to evaporate from emitter 16 and must be continually replenished to maintain the low work function at apex 22. A reservoir 28 of the coating material is typically provided to replenish the coating on emitter 16. The material from reservoir 28 diffuses along the surface and through the bulk of emitter 16 toward apex 22, thereby continually replenishing the coating there. Schottky emitter 12 includes a reservoir 28 of coating material positioned at the junction of emitter 16 and filament 14. Methods for coating emitters and fabricating reservoirs of coating materials are known. For example, reservoir 28 may be formed by adding a powder of a precursor material, such as zirconium hydride, to a solvent, such as water or isoamyl acetate, to make a slurry and then adhering the slurry to the emitter 16. When the emitter is heated, the zirconium hydride decomposes into zirconium and hydrogen, which evolves off. The emitter 16 is then heated in an atmosphere of oxygen to form a zirconium oxide coating and reservoir. It will be understood that the term zirconium oxide is used to indicate any combination of zirconium and oxygen atoms and is not limited to any particular atomic ratio.

At the high operating temperatures of the Schottky emitter 12, not only does the coating material on emitter 16 and apex 22 evaporate, the coating material also evaporates directly from the reservoir, depleting it. The evaporation rate of the coating material in the reservoir increases exponentially with the temperature. Thus, the useful life of the reservoir depends upon the amount of material in the reservoir and its temperature. At a constant temperature, increasing the mass of the reservoir increases its life. Large increases in reservoir mass are not practical, however, because the coating material in a large reservoir tends to separate from the emitter, reducing the reservoir mass and causing problems in the vacuum system.

When reservoir 28 is depleted, Schottky emitter 12 no longer functions properly, and it is necessary to shut down the electron beam system in which Schottky emitter 12 is installed to replace the emitter. Because such electron beam systems are often critical links in the manufacturing of complex integrated circuits, shutting down a system can delay production and is therefore costly. It is desirable, therefore, to extend the life of the reservoir as much as possible, thereby extending the life of the emitter.

FIG. 2 shows a part of another prior art Schottky emitter 34, similar to the one described in J. E. Wolfe, "Operational Experience with Zirconiated T-F Emitters," *J. Vac. Sci. Tech.* 16(6) (1979) and U.S. Pat. No. 5,449,968 to Terui for "Thermal Field Emission Cathode." FIG. 2 shows an emitter 36 connected to a filament 38 at a junction 44 and terminating in an apex 46. (Emitter 12 of FIG. 1 also included a junction, but it was hidden by reservoir 28.) Because heat is supplied to emitter 36 from filament 38, the emitter 36 is hottest at junction 44 and is cooler as the distance from junction 44 increases. Schottky emitter 34 includes a reservoir 50 positioned away from junction 44 towards apex 46. Positioning reservoir 50 away from junction 44 allows the reservoir 50 to remain cooler during operation, thereby reducing evaporation of the coating material and increasing the useful life of the emitter. However, positioning reservoir 50 too close to apex 46 adversely affects the electric field used to pull electrons from apex 46. According to U.S. Pat. No. 5,449,968, the optimum position for the reservoir is at approximately 200 $\mu$m away from junction 44 toward apex 46.

At such a position, reservoir 50, though cooler than junction 44, is still hotter than apex 22. Evaporation still limits the life of reservoir 50, and its lifetime is still the limiting factor oft he useful life of Schottky emitter 34.

SUMMARY OF THE INVENTION

An object of the invention is, therefore, to provide an electron emitter having an extended useful life.

Another object of the invention is to provide a longer lasting reservoir for an electron emitter.

Still another object is to provide a method of manufacturing an electron emitter having an extended life.

Yet another object of the invention is to increase the reliability of electron beam systems such as electron microscopes.

Still a further object oft he invention is to provide an electron beam system requiring reduced maintenance due to improved electron source lifetime.

The invention comprises a an electron emitter, preferably a Schottky emitter, having an extended useful life, a method of manufacturing the electron emitter, a method of providing electrons for an electron beam system, and an electron beam system using the electron emitter. In accordance with the invention, an electron emitter includes an emitter and a filament attached to the emitter at a junction. The emitter extends forward from the junction and terminates in an apex from which electrons are emitted. The emitter also extends rearward from the junction, and a reservoir of material for coating the emitter is positioned on the portion of the emitter extending rearward from the junction.

Applicants have discovered that an adequate coating is maintained at the emitter apex when the reservoir is positioned on the opposite side of the junction from the apex, even though the coating material must diffuse through a greater distance to reach the apex and the diffusion path is across the junction, which is the hottest part of the emitter. By positioning the reservoir on the rearward-extending portion of the emitter, the distance between the reservoir and the junction is not limited by the distance between the junction and the apex, and the reservoir can be positioned far from the junction without adversely affecting the electric field at the apex. By positioning the reservoir further from the junction, the reservoir is maintained at a lower temperature than in prior art emitters, in which the reservoir is at a temperature typically less than that of the junction and greater than that of the apex. The coating material in the reservoir of the present invention evaporates more slowly, greatly improving the useful life of the emitter. In some embodiments, the reservoir is positioned at a distance greater than or equal to the distance from the junction to the apex, and the reservoir can be maintained at a temperature lower than that of the apex.

The foregoing has outlined rather broadly the features and technical advantages of the present invention in order that the detailed description of the invention that follows may be better understood. Additional features and advantages oft he invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENTS

Figure 1:
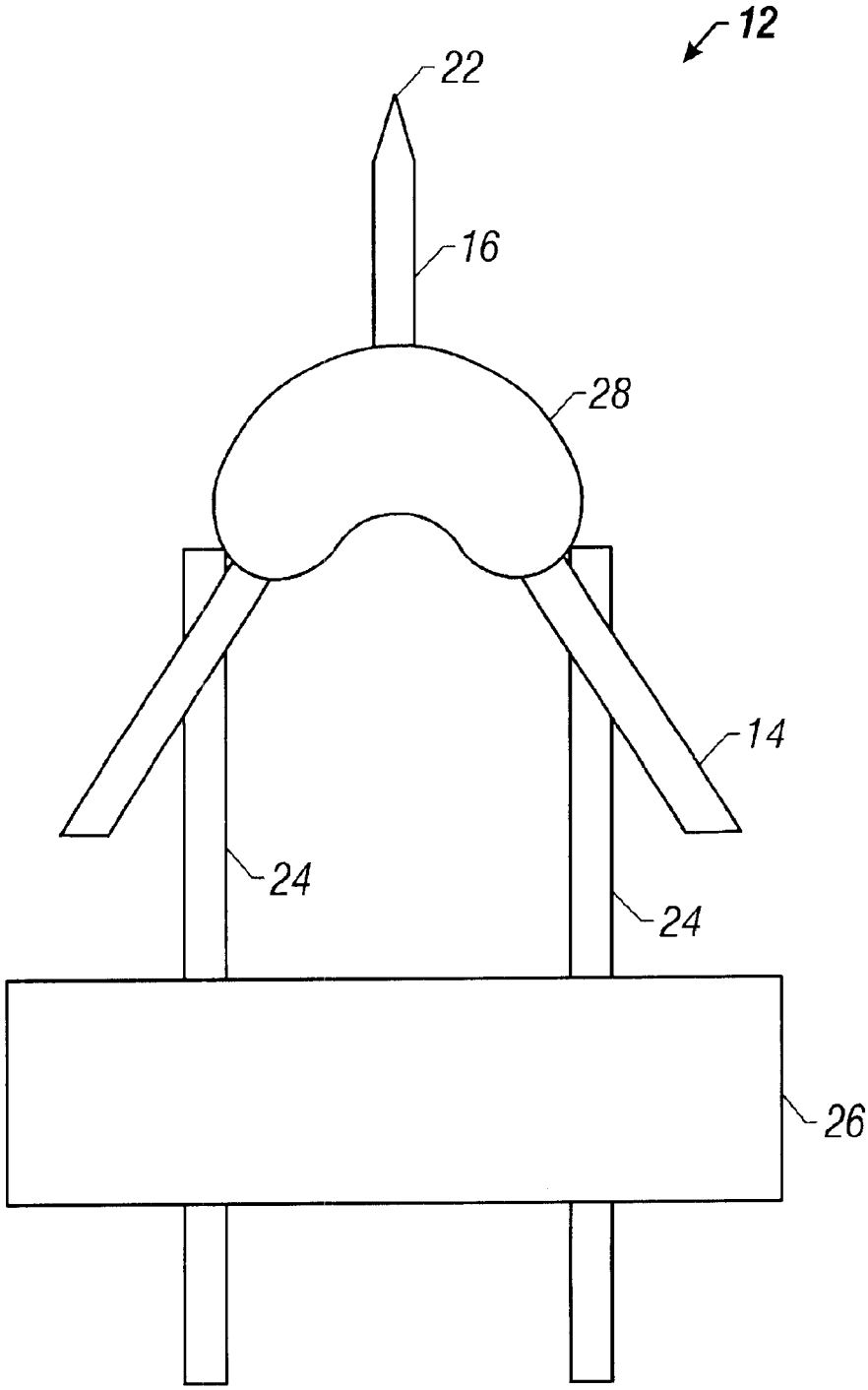
FIG. 1 (Prior Art)
FIG. 1 shows a part of prior art Schottky emitter.
Figure 2:
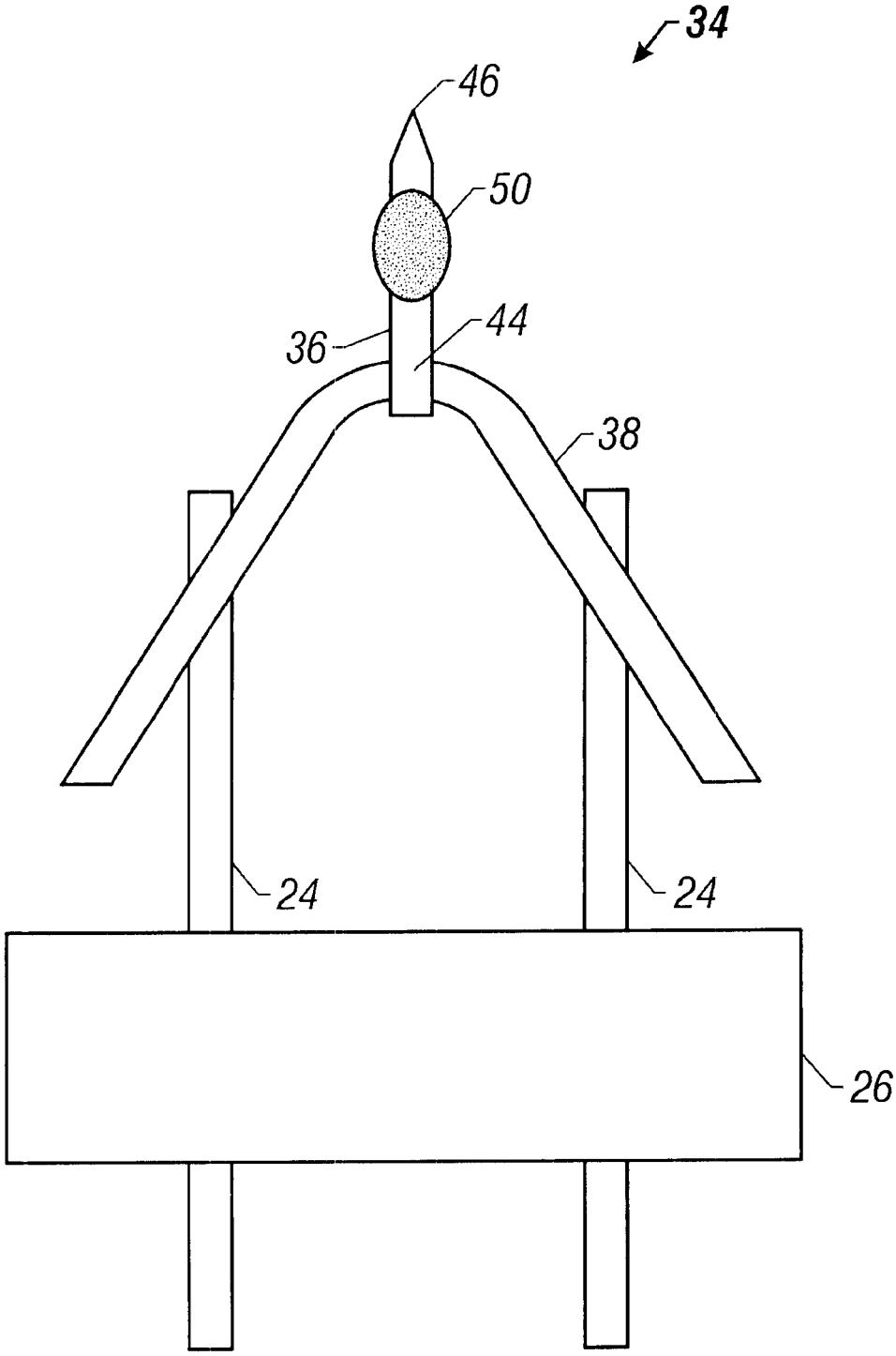
FIG. 2 (Prior Art)
FIG. 2 shows a part of another prior art Schottky emitter.
Figure 3:
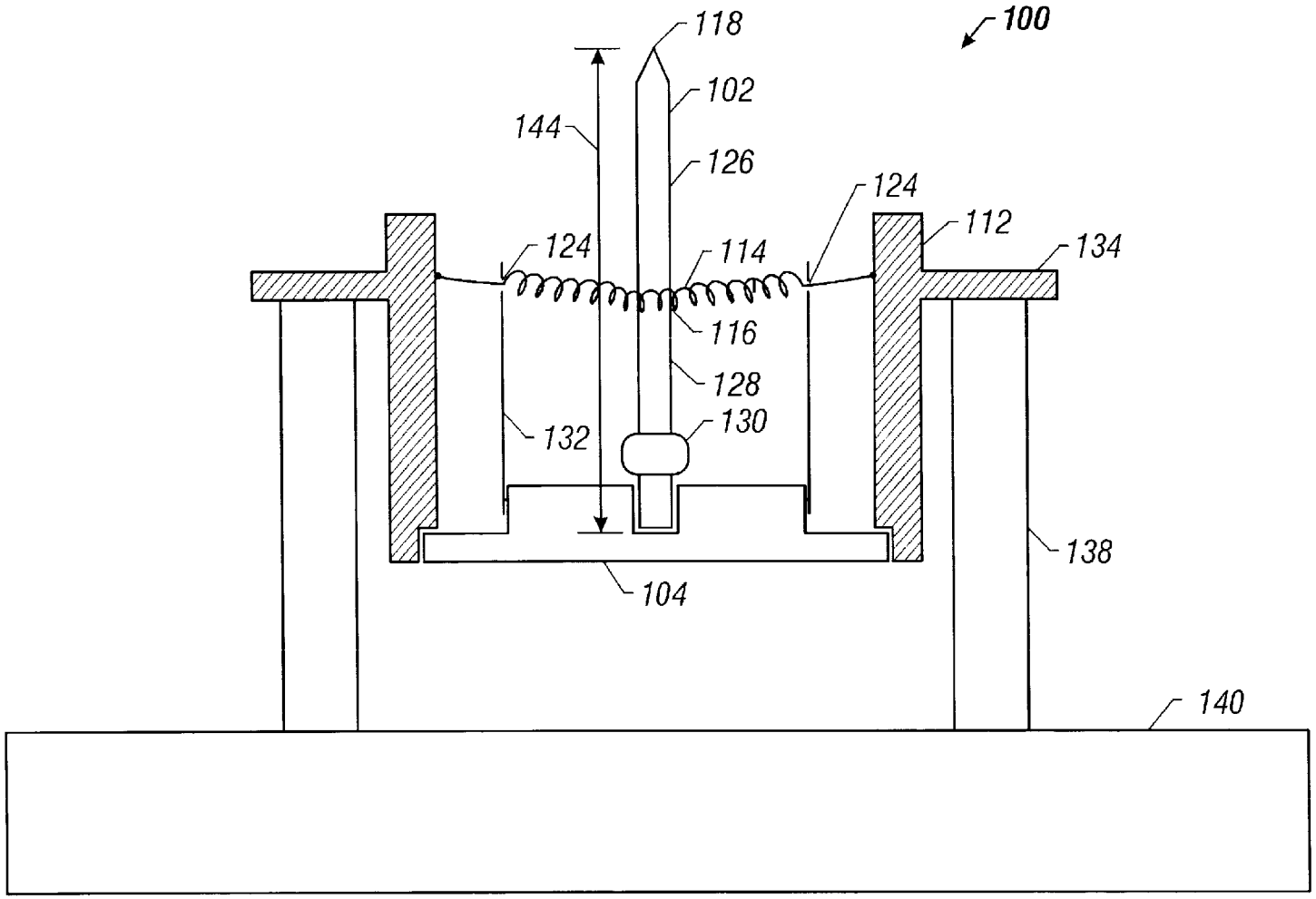
FIG. 3 shows another embodiment of a Schottky emitter of the present invention.

FIG. 3 shows an embodiment of a long lifetime Schottky emitter 100 of the present invention. Schottky emitter 100 includes an emitter 102, attached to a base 104, for example, by brazing. Emitter 102 includes an apex 118 from which electron are emitted during operation. An insulating shell 112, preferably aluminum oxide, extends from base 104 in the same direction as emitter 102. One or more heating filaments 114 are attached to emitter 102, preferably by brazing, at a junction 116. An electric current heats passes through and heats filament 114, which in turn heats emitter 102 to maintain an apex 118 at the preferred temperature of 1,800 K. Emitter 102 includes a forward extending portion 126 that extends from junction 116 to apex 118 and rearward extending portion 128 that extends from 116 toward base 104.

A reservoir 130 of a coating material, such as zirconium or hafnium, is positioned along rearward extending portion 128 to continually replenish the coating material from emitter 102 as it evaporates. Base 104 is made of a material, such as zirconium, hafnium, titanium, tantalum, or rhenium, that is able to withstand high temperatures. Base 104 preferably comprises the same material as reservoir 130, thereby providing a concentration gradient that favors diffusion from reservoir 130 toward apex 118 rather than toward base 104. Base 104 also functions as a heat sink, maintaining reservoir 130 at a temperature significantly lower than that of apex 118. A cylindrical heat shield 132 preferably made of the same material that comprises reservoir 130 insulates emitter 102 to reduce power consumption and includes apertures 124 for passing heating filaments 114. An insulating shell 112 includes a lip 134 that is supported by a supporting cylinder 138, preferably made of titanium, which in turn is supported by a support base 140, preferably of aluminum oxide. A suppressor cap (not shown) can be mounted to support base 140 and maintained at an appropriate voltage to prevent emission of unwanted electrons from Schottky emitter 100.

By varying the length 144 of emitter 102, the depth of insulating shell 112, and the position of reservoir 130 along emitter 102, the temperature of reservoir 130 can be controlled while maintaining apex 118 at a desired temperature. Skilled persons will be able to adjust without undue experimentation the dimensions in accordance with the requirements of a specific application. Applicants believe that advantageous results would be achieved with a emitter length 144 of approximately 0.5 cm, with approximately 0.025 cm of emitter 102 being embedded into base 104, and filament 114 being attached approximately half way between base 104 and apex 118. In a preferred embodiment, emitter 102 comprises a single crystal of tungsten oriented in the <100> direction, reservoir 130 comprises zirconium and oxygen, and base 104 comprises zirconium.

Figure 4:
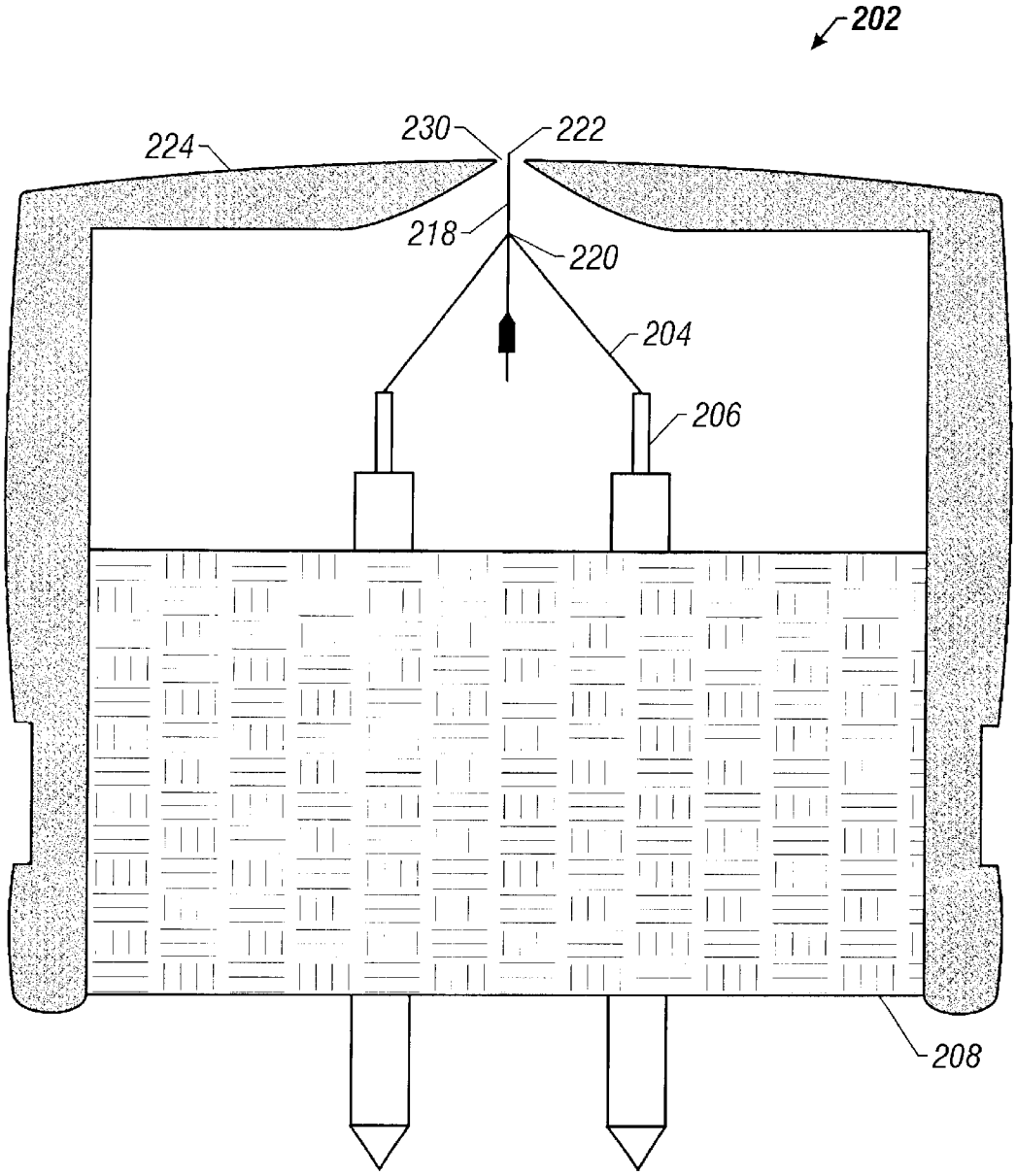
FIG. 4 shows a Schottky emitter of the present invention.

FIG. 4 shows another Schottky emitter 202 embodying the present invention. In Schottky emitter 202, a heating filament 204 that is attached to a pair of electrodes 206 that extend through an insulating base 208. An emitter 218 preferably comprises a single crystal of tungsten oriented in the <100> direction and is attached, typically by spot welding, to filament 204 at a junction 220. During operation, an electric current is passed through electrodes 206 to filament 204. The current heats filament 204, which transfers heat through junction 220 to emitter 218, maintaining an apex 222 of emitter 218 at approximately 1,800 K. A suppressor cap 224 extends from insulating base 208 and surrounds most of the assembly including electrodes 206, filament 204, and emitter 218. Suppressor cap 224 is typically charged with a negative voltage to suppress unwanted electron emission. An aperture 230 in suppressor cap 224 permits emitted electrons to exit electron source 202 into the electron optics (not shown) of the instrument into which Schottky emitter 202 is mounted.

Figure 5:
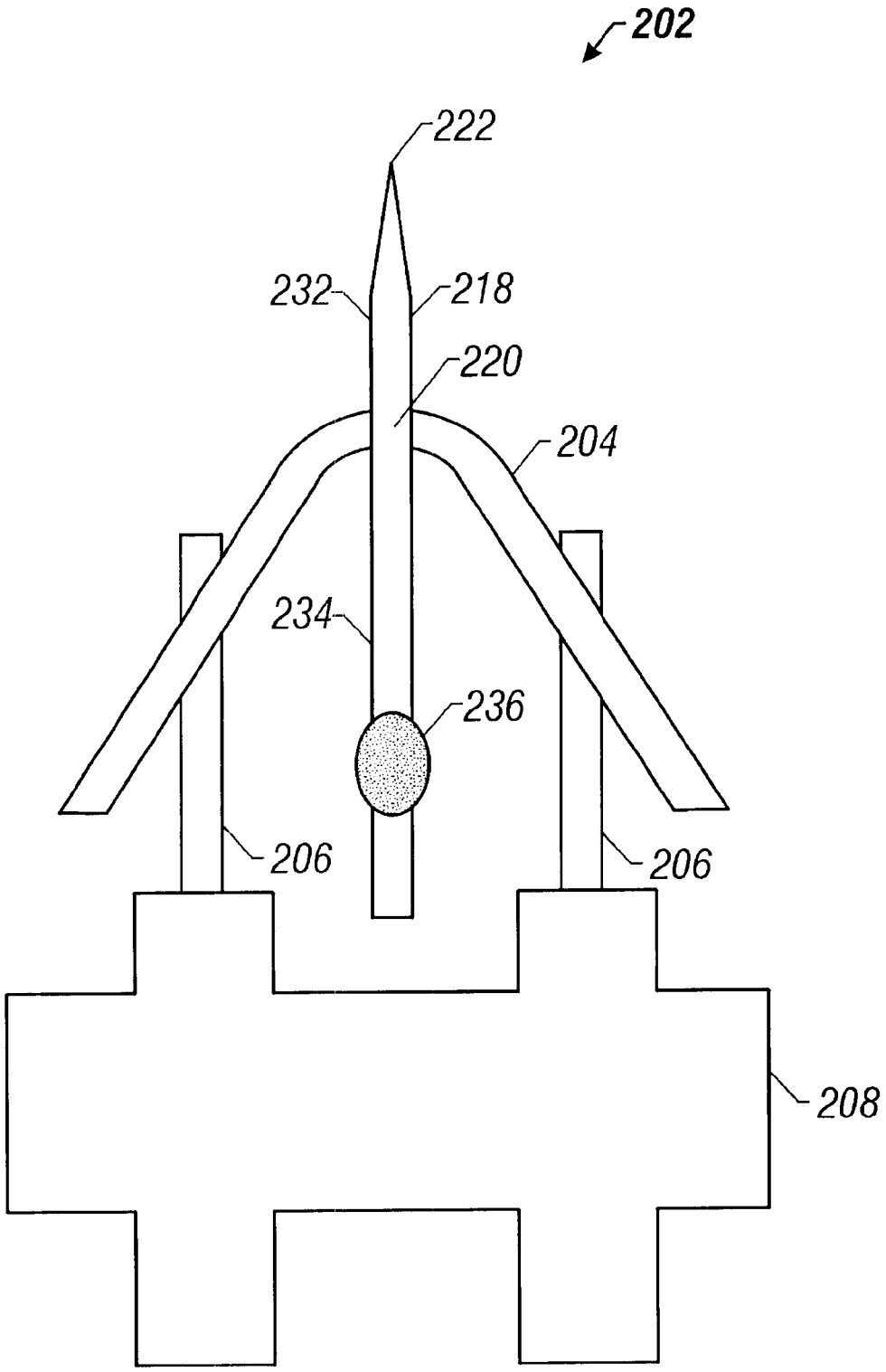
FIG. 5 is an enlarged view of a part of the emitter of FIG. 4.

FIG. 5 shows the Schottky emitter 202 of FIG. 4 enlarged and with suppressor cap 224 removed. To more clearly show the invention, the parts of Schottky emitter 202 are not shown to scale. FIG. 5 shows that emitter 218 includes a forward-extending portion 232 that extends from junction 220 in a direction away from insulating base 208 to terminates in apex 222 and a rearward extending portion 234 that extends from junction 220 in a direction back toward insulating base 208. A reservoir 236 of a coating material that lowers the work function of emitter 218 is positioned on rearward extending portion 234, preferably centered approximately 35 mils (0.9 mm) away from junction 220. Reservoir 236 can be positioned anywhere on rearward extending portion 234, but is preferably positioned centered between 10 mil (0.25 mm) and 100 mil (2.5 mm) from junction 220. Reservoir 236 preferably comprises zirconium and oxygen. Material from the reservoir diffuses by surface and/or bulk diffusion to coat apex 222, thereby reducing the work function of emitter 218. The reservoir can be formed in a known manner, such as the one described above.

Figure 6:
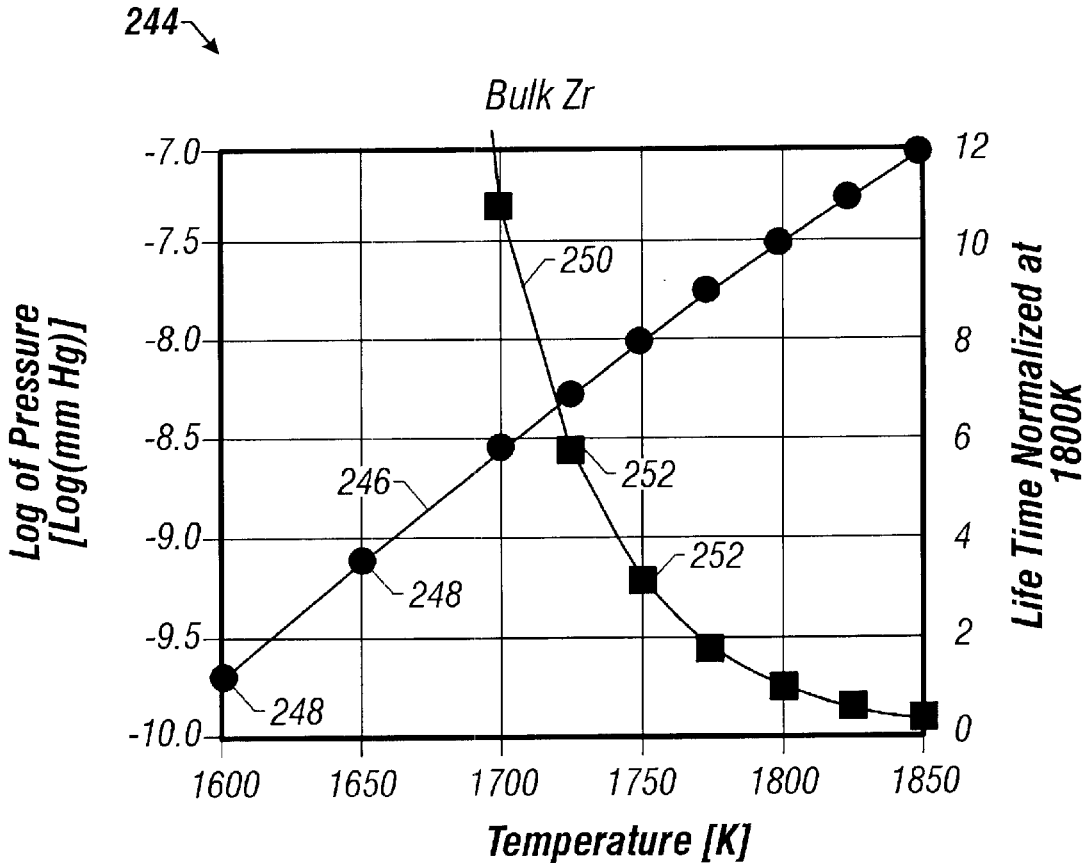
FIG. 6 is a graph showing the relationship between the partial pressure of zirconium and temperature and the relationship between reservoir lifetime and temperature.

The useful life of the Schottky emitter 202 is often determined by the life of reservoir 236, and the life of reservoir 236 is limited by the evaporation rate of the reservoir material. The evaporation rate of the reservoir material is strongly influenced by the temperature of the reservoir. It has been found that the evaporation rate decreases exponentially as the temperature is reduced and that the lifetime of a zirconium oxide reservoir approximately doubles for every 25 K drop in temperature. FIG. 6 is a graph 244 showing the change in partial pressure of zirconium with temperature and the relationship between Schottky emitter lifetime and temperature. A line 246 defined by round dots 248 shows the partial pressure of pure zirconium at various temperatures. The data for line 246 is derived from Smithells Metals Reference Book, $6^{th}$ Ed., published by Butterworth and Co. in 1983. Line 246 shows the partial pressure for pure zirconium because data was not readily was available showing the partial pressure of zirconium oxide. The temperature dependence of the vapor pressure of zirconium can also be represented as $\log P = -31820/T - 0.50 \log T$, with pressure in inches of mercury and temperature in Kelvin. A second line 250, defined by square dots 252, shows the predicted Schottky emitter lifetime as a function of temperature compared with the lifetime of a Schottky emitter operating with the reservoir at 1,800 K, which is assigned a value of 1.

Figure 7:
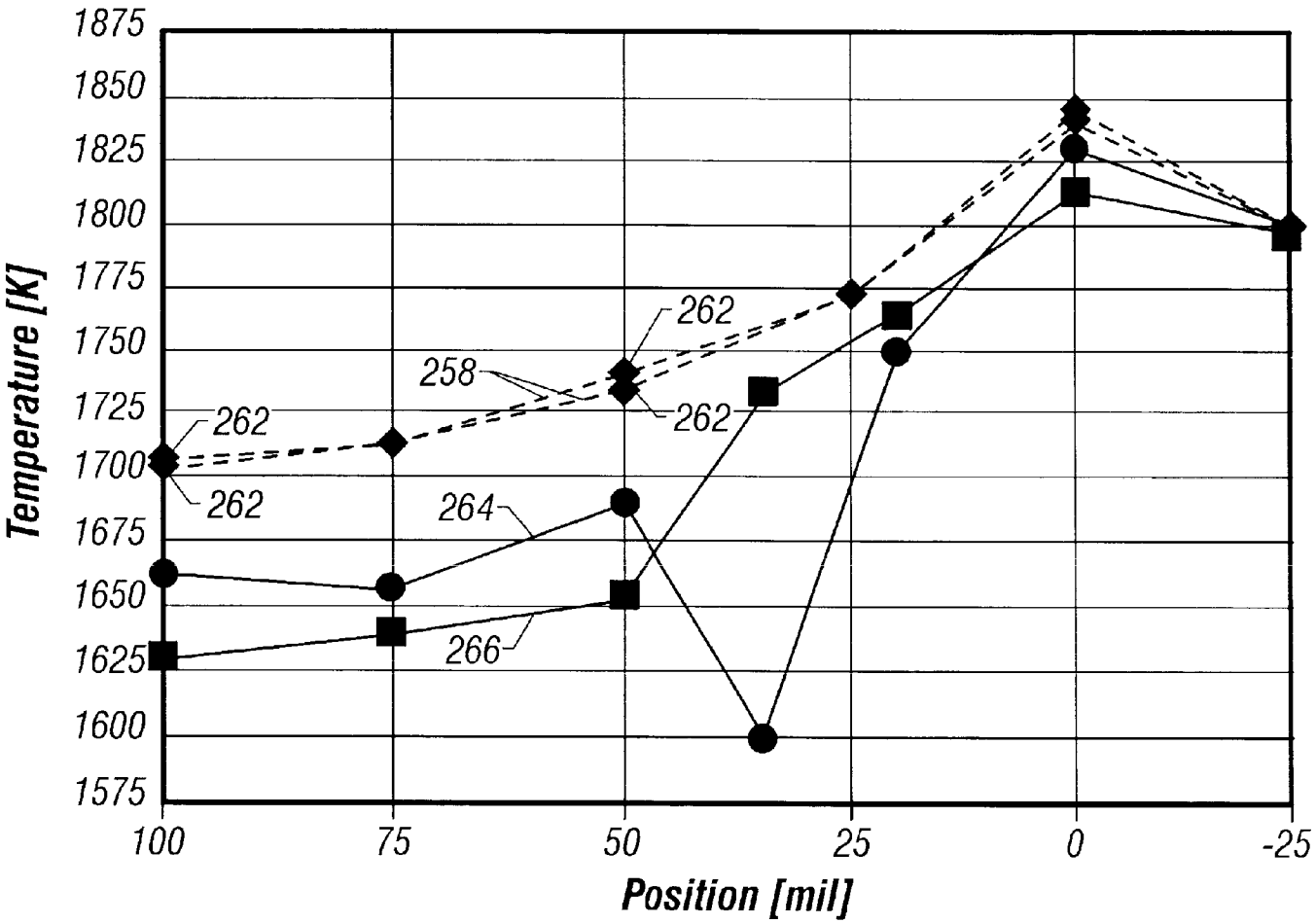
FIG. 7 is a graph showing how the temperature of a typical Schottky emitter varies with distance from the junction.

FIG. 7 shows the temperature as measured by a pyrometer at different positions along the length of four different Schottky emitters. The horizontal axis shows the distance from junction 220 (FIG. 5), which has an abscissa of zero. Distances in the direction from junction 220 toward apex 222, which has an abscissa of −25 mils (0.64 mm), are shown as negative numbers. Distances in the direction from junction 220 away from apex 222 are shown as positive numbers. Lines 258 show two sets of measurements, indicated by diamond-shaped dots 262, for emitters similar to that shown in FIGS. 4 and 5, but without reservoirs 236. Lines 264 and 266 show the temperature profiles of two emitters similar to those of FIGS. 4 and 5 having reservoirs 236 positioned on rearward-extending portion 234 approximately 35 mils (0.89 mm) from junction 220. Pyrometer measurements directly on the reservoir are not accurate, due to the difference in emissivity of the reservoir material compared to that of the material comprising emitter 218. Thus, the temperature at reservoir 236 is assumed to be the average of the two readings at equal distances on opposite sides of the reservoir, rather than the temperature indicated by the pyrometer.

As can be seen from FIG. 7, the emitter 218 is hottest at junction 220, and the temperature along emitter 218 decreases as the distance from junction 220 increases. By extending emitter 218 rearward and mounting reservoir on rearward extending portion 234, the temperature of reservoir 236 is significantly reduced. Unlike prior art Schottky emitters, the distance of the reservoir from the junction in the present invention can be increased without adversely affected the electric field at apex 222. Unlike prior art emitters, the temperature of reservoir can even be reduced even below that of apex 222. Lines 264 and 266 show that the temperature of reservoir 236 averages approximately 1710 K. Applicants have measured the temperature of reservoirs in prior art Schottky emitter and have found that the temperature at the reservoirs was approximately 1850 K for a typical apex temperature of 1,800 K. Thus, the reservoir temperature in the present invention has been reduced approximately 140 K, which implies that the lifetime of the emitter should be increased by a factor of 10 or greater.

Applicants have found that the current versus voltage characteristics of the electron source 202 of FIGS. 4 and 5 are similar to those of prior art Schottky emitters 12 having a reservoir 28 positioned between junction 44 and apex 222, thus indicating that the coating material in the emitter of the present invention 222 and lowering the work function.

Another advantage of the invention over prior art Schottky emitters is temperature stability. The reservoir shrinks as mass evaporates or diffuses away. In prior art reservoirs, the reduction in the mass between the heat source and the apex causes the temperature at the apex to increase over time. Because the reservoir oft he current invention is not located between the filament and the apex, changes in reservoir mass should have little or no effect on the temperature at he apex. Moreover, changes in emitter temperature have been observed with filament temperature remaining constant. It is thought that these fluctuations may be attributable to the reservoir, and that moving the reservoir to the side of the emitter away from the filament may reduce or eliminate such temperature fluctuations. The present invention also allows the use of a shorter emitter, with the apex positioned closer to the filament than in the prior art. The shorter emitter consumes less input power, and may offer other advantages, such as improved stability, as well.

A Schottky emitter can also be operated in an emission mode that requires a temperature so high that the coating material evaporates and does not coat the apex. In prior art Schottky emitters, operation at such temperatures would not only evaporate the coating material from the emitter, it would also deplete the reservoir. With the present invention, it is possible to operate with the apex at such temperatures without depleting the reservoir. When the temperature of the emitter is subsequently lowered, coating material will again diffuse from the reservoir and coat the apex allowing the emitter to operate again in a thermal field mode.

The invention is not limited to any particular materials used to make the emitter, coating or filament, nor to any specific design of the electron emitter. For example, any of the emitter or coating materials described in the "Background of the Invention" section can be used. Although the preferred embodiment is a Schottky emitter, the invention can be used in any electron source having a similar configuration and using a work function lowering coating which is replenished from a reservoir.

Figure 8:
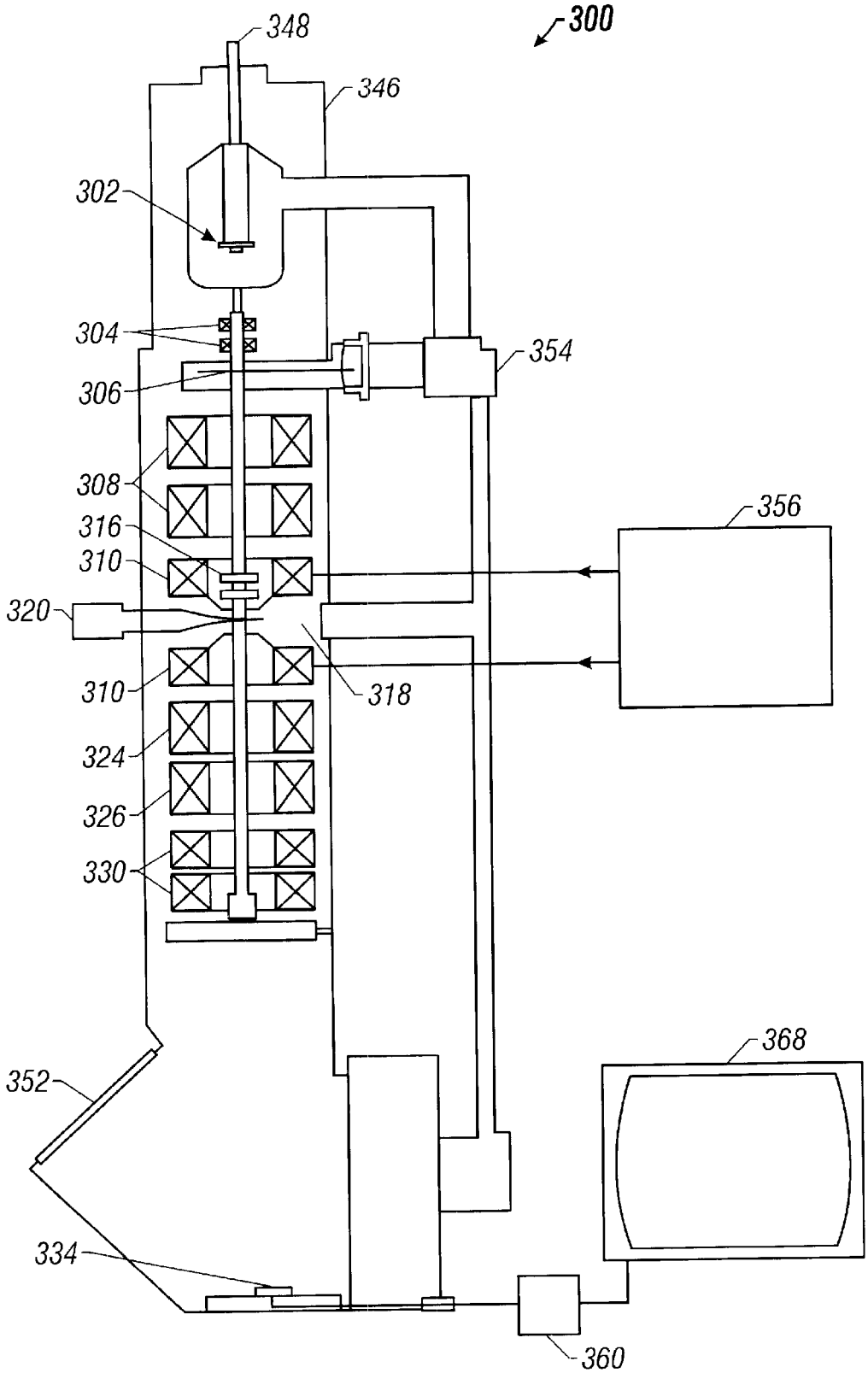
FIG. 8 is a schematic representation of an electron beam system using a Schottky emitter of the present invention.

FIG. 8 shows an electron beam apparatus having requiring reduced maintenance due to improved electron source lifetime. The exemplary electron beam apparatus is an electron microscope 300. The apparatus includes an electron source 302 comprising a Schottky emitter of the present invention as described above, a beam alignment system 304 and a beam diaphragm 306, a condenser lens 308, objective lenses 310, a beam scanning system 316, an object space 318 with a specimen holder 320, a diffraction lens 324, an intermediate lens 326, a projection lens 330 and an electron detector 334. Objective lenses 310, intermediate lens 326 and projection lens 330 together constitute an imaging lens system. These elements are accommodated in a housing 346 provided with an electric supply lead 348 for electron source 302, a viewing window 352 and a vacuum pumping device 354. The excitation coils for the objective lens 310 are connected to a control unit 356 which is arranged to control the excitation of the imaging lens system. The electron microscope also includes a recording unit with the electron detector 334, an image processing unit 360 and a video display 368 for observing the images formed.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

We claim as follows:

1. An electron source assembly, comprising:

an insulating base;

a pair of electrodes penetrating the base;

a filament in electrical contact with the electrodes;

an emitter attached to the filament at a junction and having an apex from which electrons are emitted, the emitter extending in two directions from the junction;

a reservoir of material for coating the emitter, a preponderance of the reservoir positioned on the emitter on the side of the junction opposite to that of the apex; and a suppressor cap surrounding the emitter and having a aperture, the suppressor cap suppressing the emission of undesired electrons and permitting the passage of electrons used to form an electron beam.

2. The electron source assembly of claim 1 in which the reservoir is positioned a sufficient distance from the junction to produce an operating temperature at the reservoir less than that at the junction to increase the useful life of the electron emitter.

3. An electron source assembly comprising:

an insulating base;

a pair of electrodes penetrating the base;

a filament in electrical contact with the electrodes;

an emitter attached to the filament at a junction and having an apex from which electrons are emitted, the emitter extending in two directions from the junction;

a reservoir of material for coating the emitter, the reservoir positioned on the emitter on the side of the junction opposite to that of the apex at a sufficient distance from the junction to produce an operating temperature at the reservoir less than that at the apex to increase the useful life of the electron emitter; and a suppressor cap surrounding the emitter and having a aperture, the suppressor cap suppressing the emission of undesired electrons and permitting the passage of electrons used to form an electron beam.

4. The electron source assembly of claim 1 in which the reservoir is positioned a sufficient distance from the filament to reduce the temperature by at least 25 degrees from that of the emitter at the junction.

5. An electron source assembly comprising:

an insulating base;

a pair of electrodes penetrating the base;

a filament in electrical contact with the electrodes;

an emitter attached to the filament at a junction and having an apex from which electrons are emitted, the emitter extending in two directions from the junction;

a reservoir of material for coating the emitter, the reservoir positioned on the emitter on the side of the junction opposite to that of the apex and at least a portion of the reservoir positioned further away from the filament than is the apex; and a suppressor cap surrounding the emitter and having a aperture, the suppressor cap suppressing the emission of undesired electrons and permitting the passage of electrons used to form an electron beam.

6. An electron source assembly comprising:

an insulating base;

a pair of electrodes penetrating the base;

a filament in electrical contact with the electrodes;

an emitter attached to the filament at a junction and having an apex from which electrons are emitted, the emitter extending in two directions from the junction;

a reservoir of material for coating the emitter, the reservoir positioned at least 10 mil from the junction on the side of the junction opposite to that of the apex; and a suppressor cap surrounding the emitter and having a aperture, the suppressor cap suppressing the emission of undesired electrons and permitting the passage of electrons used to form an electron beam.

7. The electron source assembly of claim 1 in which the filament comprises tungsten, rhenium or tantalum.

8. The electron source assembly of claim 1 in which the reservoir includes zirconium, titanium, hafnium, yttrium, niobium, vanadium, thorium, scandium, beryllium or lanthanum.

9. An electron source assembly, comprising:

a base;

an emitter extending from and in thermal contact with the base;

a filament attached to the emitter at a junction positioned away from the base;

a reservoir of coating material positioned between the filament and the base, the reservoir being maintained at a temperature lower than that of the filament.

10. The electron source assembly of claim 9 in which the emitter has an apex and in which the reservoir is maintained during operation at a temperature lower than that of the apex.

11. The electron source assembly of claim 9 further comprising a heat shield for insulating the emitter.

12. In an electron source assembly including a filament, an emitter attached to the filament at a junction and having an apex from which electrons are emitted, and a reservoir of material for coating the emitter to lower its work function, the improvement comprising the emitter extending from the junction in a direction away from the apex and a preponderance of the reservoir positioned on the emitter on the side of the junction opposite to that of the apex.

13. The electron source assembly of claim 12 in which the electron emitter comprises a Schottky emitter.

14. In an electron source assembly including a filament, an emitter attached to the filament at a junction and having an apex from which electrons are emitted, and a reservoir of material for coating the emitter to lower its work function, the improvement comprising the emitter extending from the junction in a direction away from the apex, the reservoir positioned on the emitter on the side of the junction opposite to that of the apex, and the portion of the emitter extending from the junction in a direction away from the apex contacting a base that conducts heat from the emitter.

15. The electron source assembly of claim 12 further comprising a base and in which the emitter is supported by the base.

16. In an electron source assembly including a base, a filament, an emitter attached to the filament at a junction and having an apex from which electrons are emitted, and a reservoir of material for coating the emitter to lower its work function, the improvement comprising:

the emitter being supported on the side opposite the apex by a base comprising the same material as the reservoir and the reservoir being positioned on the emitter on between the junction and the base.

17. The electron source assembly of claim 12 in which the only heat conduction path to the emitter is through the filament.

18. The electron source assembly of claim 12 in which the reservoir is positioned a sufficient distance from the junction to produce an operating temperature at the reservoir less than that at the junction to increase the useful life of the electron emitter.

19. The electron source assembly of claim 12 in which the reservoir is positioned a sufficient distance from the junction to produce an operating temperature at the reservoir less than that at the apex to increase the useful life of the electron emitter.

20. The electron source assembly of claim 12 in which the reservoir is positioned a sufficient distance from the filament to reduce the temperature by at least 25 degrees from that of the emitter at the junction.

21. In an electron source assembly including a filament, an emitter attached to the filament at a junction and having an apex from which electrons are emitted, and a reservoir of material for coating the emitter to lower its work function, the improvement comprising the emitter extending from the junction in a direction away from the apex, the reservoir positioned on the emitter on the side of the junction opposite to that of the apex, and a portion of the reservoir positioned further away from the filament than is the apex.

22. In an electron source assembly including a filament, an emitter attached to the filament at a junction and having an apex from which electrons are emitted, and a reservoir of material for coating the emitter to lower its work function, the improvement comprising the emitter extending from the junction in a direction away from the apex, the reservoir positioned on the emitter on the side of the junction opposite to that of the apex, and between approximately 10 mil and 100 mil from the junction.

23. The electron source assembly of claim 12 in which the emitter comprises tungsten, molybdenum rhenium or iridium oriented in the <100>, <110>, <111>, or <310> direction.

24. The electron source assembly of claim 12 in which the material for coating the emitter to lower its work function includes zirconium.

25. The electron source assembly of claim 12 in which the material for coating the emitter to lower its work function includes a compound of a first material selected from the group of zirconium, titanium, hafnium, yttrium, niobium, vanadium, thorium, scandium, beryllium or lanthanum and a second material selected from the group of nitrogen, oxygen, and carbon.

26. An electron beam system including an electron source comprising a electron source assembly including a filament, an emitter attached to the filament at a junction and having an apex, and a reservoir of material for coating the emitter to lower its work function, the emitter extending from the junction in a direction away from the apex and a preponderance of the reservoir positioned on the emitter on the side of the junction opposite to that of the apex.

27. The electron beam system of claim 26 in which the electron beam system comprises an electron microscope.

28. The electron source assembly of claim 1 in which the reservoir of material comprises a material deposited being deposited using a liquid carrier.

29. The electron source assembly of claim 1 in which the reservoir is non-uniformly distributed on the emitter.

30. The electron source assembly of claim 12 in which the reservoir of material comprises a material deposited being deposited using a liquid carrier.

31. The electron source assembly of claim 12 in which the reservoir is non-uniformly distributed on the emitter.

* * * * *